US007361131B1

(12) United States Patent
Abrott

(10) Patent No.: US 7,361,131 B1
(45) Date of Patent: Apr. 22, 2008

(54) SYSTEMS AND METHODS FOR PROCESSING A CONTAINER BLANK

(75) Inventor: Timothy J Abrott, Normandy Park, WA (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/537,353

(22) Filed: Sep. 29, 2006

(51) Int. Cl.
*B31B 1/14* (2006.01)
*B26F 3/00* (2006.01)
*B26F 5/08* (2006.01)

(52) U.S. Cl. ..... 493/363; 493/59; 493/362; 493/372; 83/177; 83/564

(58) Field of Classification Search ..... 493/59, 493/61, 74, 242, 361, 362, 363, 372, 67; 83/53, 177, 564
See application file for complete search history.

(56) References Cited

U.S. PATENT DOCUMENTS 924,778 A * 6/1909 Haslop ..... 83/657
2,353,419 A * 7/1944 Smithson ..... 493/354
2,458,160 A * 1/1949 Grappe ..... 83/549
3,332,326 A * 7/1967 Haas ..... 493/363
3,334,809 A * 8/1967 Zajic et al. ..... 234/106
3,522,753 A * 8/1970 Schmied ..... 83/471.2
3,772,949 A * 11/1973 Pavone et al. ..... 83/56
4,457,196 A * 7/1984 Cady ..... 83/140
4,544,367 A * 10/1985 Vossen ..... 493/1
4,589,318 A * 5/1986 Kanski ..... 83/409.1
4,590,834 A * 5/1986 Sobel ..... 83/455
4,822,325 A * 4/1989 Vossen ..... 493/1
4,850,950 A * 7/1989 Holliday ..... 493/475
5,370,028 A * 12/1994 Grebe ..... 83/684
5,733,081 A * 3/1998 Dowdle et al. ..... 409/137
6,203,482 B1 * 3/2001 Sandford ..... 493/61
6,766,723 B2 * 7/2004 Yasoda et al. ..... 83/549
2006/0219072 A1 * 10/2006 Tynkkynen et al. ..... 83/177

* cited by examiner

*Primary Examiner*—Paul R Durand

(57) ABSTRACT

A system includes a first scoring station, an optional second scoring station, and a cutting station. The first scoring station includes a stationary platen for supporting a substrate, a movable platen juxtaposed a spaced distance therefrom, and one or more scoring rules operatively associated with the platen and movable between a substrate non-contact position and a substrate contact position by the platen. The scoring rules may be independently movable in a selective manner for creating score lines at selective locations along the substrate when the platen moves the scoring rules into the substrate contact position. The scoring rules may be configured with scoring blades having selectively adjustable lengths and locations. The scoring rules may be constructed of a plurality of scoring segments that form the scoring blade. Each scoring segment is selectively movable between a scoring position and a non-scoring position for creating customizable score line lengths and locations.

11 Claims, 9 Drawing Sheets

SYSTEMS AND METHODS FOR PROCESSING A CONTAINER BLANK

BACKGROUND

Containers in the shipping industry have been utilized for many years. Such containers are typically constructed from a suitable container blank made from an appropriate substrate such as corrugated containerboard. As generally known in the art, the container blank includes panels, flaps, etc. hingedly connected to one another via score lines. The containerboard is then folded along these score lines and glued to form the final container product.

To create such score lines, mechanical contact methods have been developed, such as flatbed press machines and rotary die cutting machines. Such machines press a scoring edge into the substrate at fixed locations for forming the panels, flaps, etc. Non-contact methods have also been developed, such as laser cutting machines. In this method, laser energy is utilized to produce both the score lines and cut outs in the substrate for forming the panels, flaps, etc.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with aspects of the present invention, a system for processing a substrate blank is provided. The system includes a first scoring station including a stationary platen. The first scoring station also includes a moveable platen juxtaposed a spaced distance from the stationary platen; and at least one scoring rule operatively associated with the moveable platen. The scoring rule is capable of movement between a substrate non-contact position and a substrate contact position by the movable platen for generating a score line on a substrate blank. The scoring rule is further selectively positionable along one dimension of the moveable platen.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Exemplary embodiments of the present invention will now be described with reference to the accompanying drawings where like numerals correspond to like elements. Exemplary embodiments of the present invention are directed to systems and methods for processing a container blank. More specifically, exemplary embodiments of the present invention include one or more mechanical scoring stations and a cutting station for processing substrate stock into a container blank.

The container blank may be formed from any cellulose based substrate. Cellulose based substrates are formed from cellulose materials such as wood pulp, straw, cotton, bagasse and the like. Cellulose based substrates useful in the present invention come in many forms such as fiberboard, containerboard, corrugated containerboard and paperboard. The following discussion proceeds with reference to an exemplary cellulosic based substrate in the form of corrugated containerboard stock, but it should be understood that the scope of the present invention is not so limited. It will be further appreciated that the containerboard stock may include but is not limited to a single face corrugated containerboard, single-wall corrugated containerboard, double-wall corrugated containerboard, triple-wall corrugated containerboard, etc. It should therefore be apparent that the examples described below are only illustrative in nature, and therefore, such examples should not be considered as limiting the scope of the present invention, as claimed.

Figure 1:
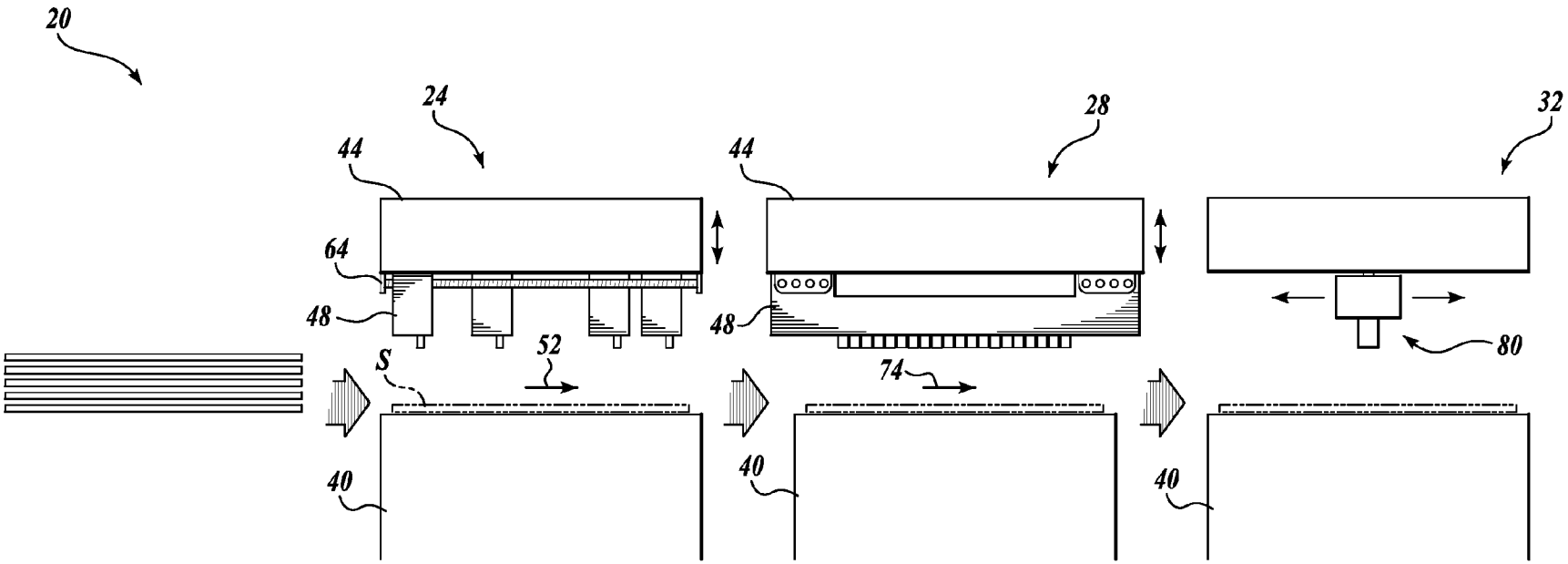
FIG. 1 is a side schematic view of one exemplary embodiment of a blank processing system constructed in accordance with aspects of the present invention.
Figure 2:
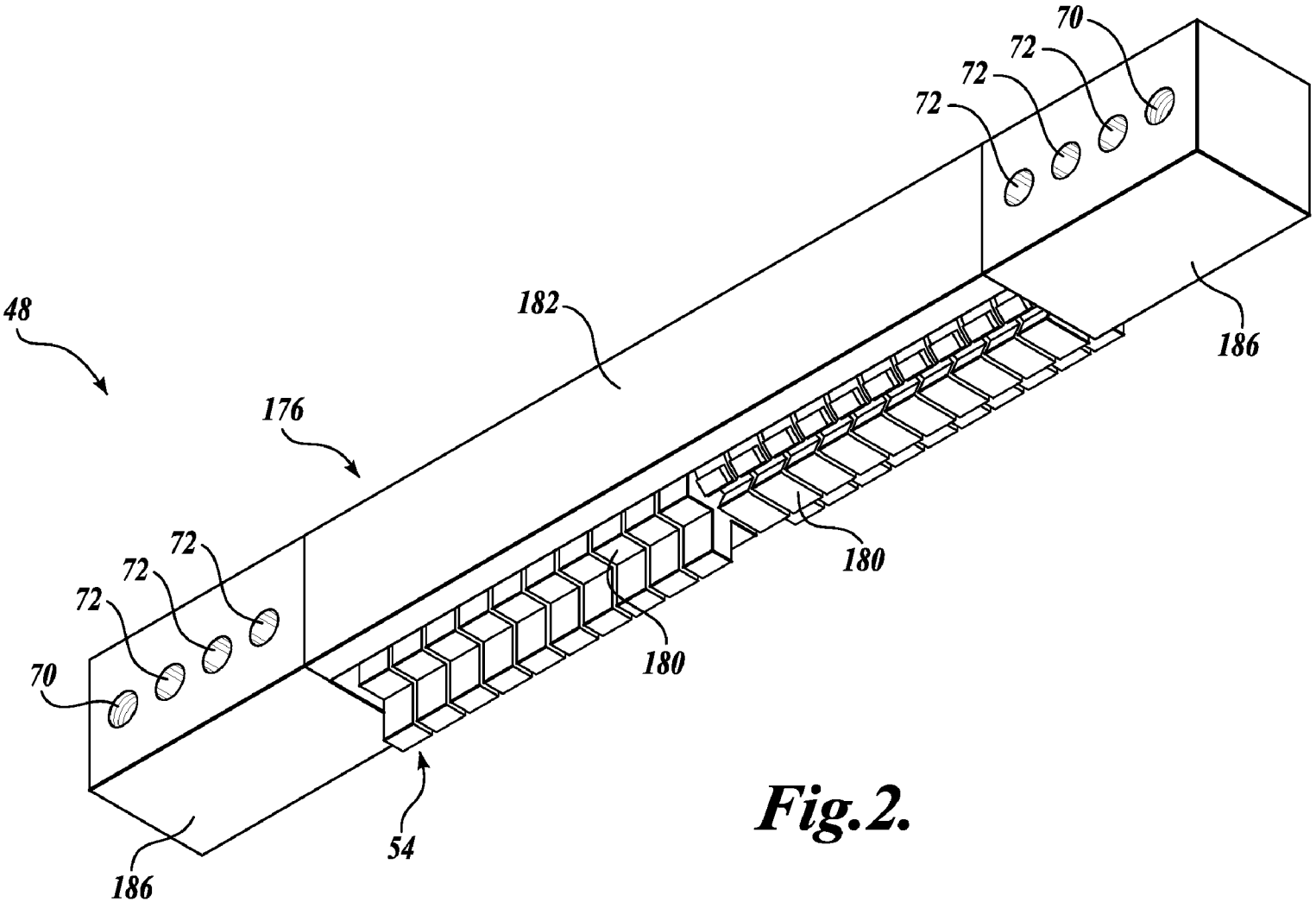
FIG. 2 is a bottom perspective view of one exemplary embodiment of a scoring rule constructed in accordance with aspects of the present invention.

Turning now to FIG. 1, there is shown a schematic representation of one exemplary embodiment of a container blank processing system, generally designated 20, formed in accordance with aspects of the present invention. As best shown in FIG. 1, the system 20 includes a first scoring station 24, an optional second scoring station 28, and a cutting station 32. As will be described in more detail below, a rectangular sheet of substrate S, such as corrugated containerboard stock, is processed sequentially through the system 20 for forming a container blank having the appropriate score lines, cutouts, and panel configurations for the desired end product. The substrate may be transferred through the system 20 either manually or via an automated system comprised of, for example, conventional conveyance means.

Referring now to FIGS. 1-8, the components of the system 20 will be described in more detail. As best shown in FIG. 1, the first scoring station 24 includes a stationary platen 40 for supporting the substrate S, a movable platen 44 juxtaposed a spaced distance from the platen 40, and one or more scoring rules 48 operatively associated with the platen 44 and movable between a substrate non-contact position and a substrate contact position by the platen 44. The platen 44 is movable between the substrate non-contact position and the substrate contact position via conventional actuators 50 (See FIG. 9). In the embodiment shown in FIG. 1, the one or more scoring rules 48 are disposed perpendicular to the substrate advancement direction illustrated by arrow 52. As will be described in more detail below, according to one aspect of the present invention, the one or more scoring rules 48 are independently movable in a selective manner for creating score lines at selective locations along the substrate when the platen 44 moves the scoring rules 48 into the substrate contact position.

Figure 8:
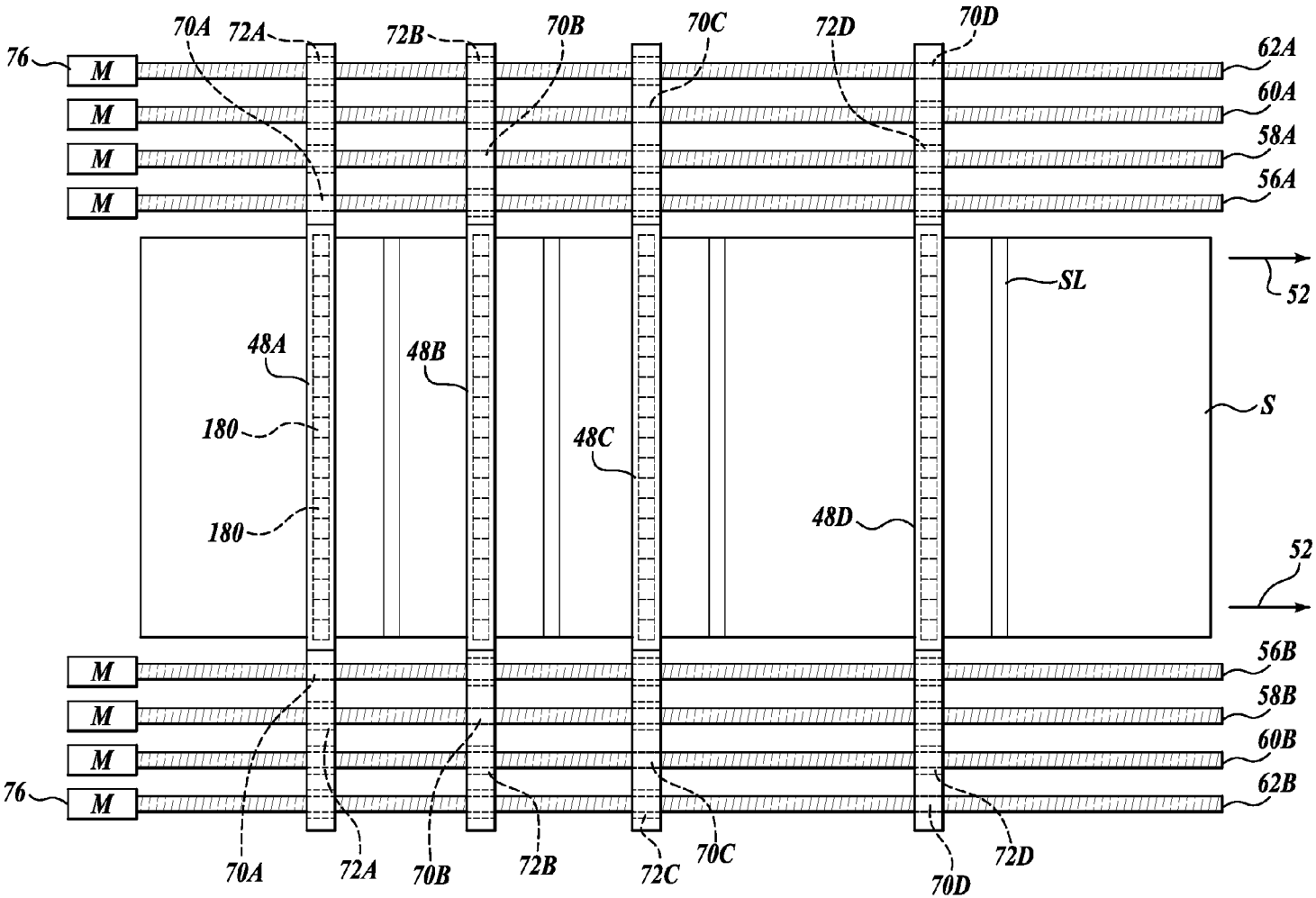
FIG. 8 is a partial top view of an exemplary embodiment of an arrangement for selectively adjusting the positions of one or more scoring rules.
Figure 9:
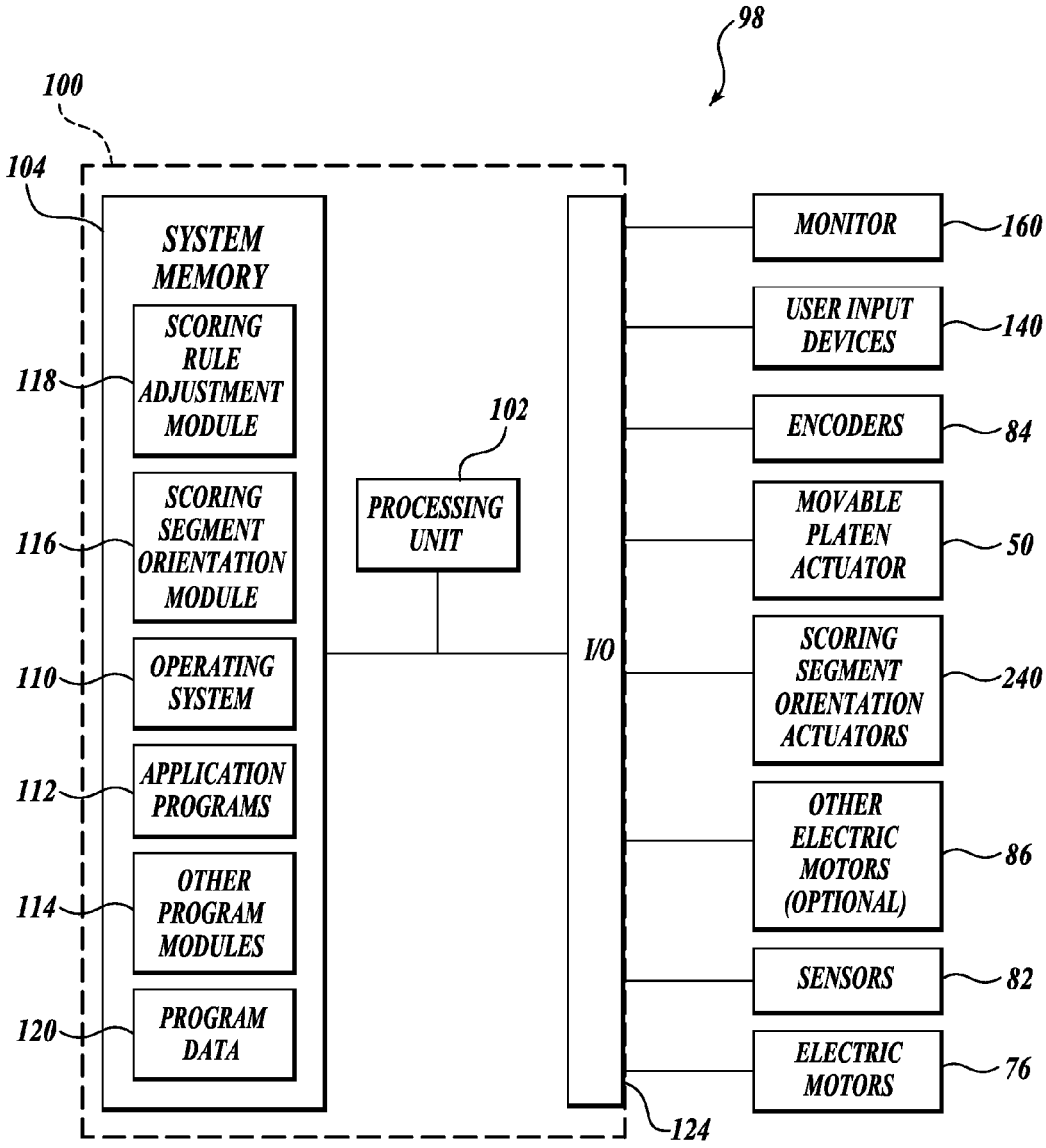
FIG. 9 is block diagram of an exemplary embodiment of a computing system suitable for use with aspects of the present invention.

Turning now to the embodiment shown in FIG. 8, there is shown four (4) scoring rules 48A-48D positioned for movement along the direction of arrow 52. Each scoring rule 48 extends approximately the width of the platen 44 and includes a scoring blade 54 having a blunted end (See FIG. 2) for producing score lines SL when pressed into contact with the substrate (i.e., when the movable platen 44 moves to the substrate contact position). The scoring rules 48A-48D are disposed parallel to one another, and parallel with the trailing and leading edges of the substrate during use. The scoring rules are independently movable with respect to the platens 40 and 44 via any known mechanism, such as motorized jack screws, one embodiment of which will be described in detail below.

In the embodiment shown in FIG. 8, four pairs of jack screws 56A-56B, 58A-58B, 60A-60B, and 62A-62B are operatively mounted on support brackets 64 (See FIG. 1) on the sides of the platen 44. The support brackets are securely mounted or otherwise carried by the platen 44 so as to provide sufficient support for the scoring rules and to handle the forces applied thereto when the scoring rules 48A-48D are pressed into the substrate. In this configuration, the ends of the scoring rules 48A-48D extend laterally outwardly of the sides of the substrate and are formed with threaded apertures 70A-70D, which act like nuts for cooperating with the respective jack screws 56A-56B, 58A-58B, 60A-60B, and 62A-62B. To avoid interference with the other jack screws, the scoring rules 48A, 48B, 48C and 48D include appropriately oversized apertures 72A-72D located at the intersection of the other jack screws.

In operation, the jack screws are rotated by reversible electric drive motors 76 through conventional transmission means (not shown). Accordingly, upon receiving appropriate drive signals from a computing system 98, jack screws 56A-56B are rotated to move the scoring rule 48A, jack screws 58A-58B are rotated to move the scoring rule 48B, jack screws 60A-60B are rotated to move the scoring rule 48C, and jack screws 62A-62B are rotated to move the scoring rule 48D.

In accordance with another aspect of the present invention, one or more of the scoring rules 48A-48D may be configured as so to have scoring edges with selectively adjustable lengths and locations. In the embodiment shown in FIG. 8, one or more of the scoring rules may be constructed of a plurality of scoring segments 180 that form the scoring blade. In these embodiments, as will be described in detail below, each scoring segment is selectively movable between a scoring position and a non-scoring position for creating customizable score line lengths and locations.

Referring now to FIGS. 2 and 3A-3C, there is shown an exemplary embodiment of a scoring rule 48 having a scoring blade 54 with selectively adjustable locations and lengths that may be practiced with aspects of the present invention. As best shown in FIGS. 2 and 3A-3C, the scoring rule 48 comprises an elongate bracket 176, a shaft 178 mounted between the ends of the bracket, and a plurality of scoring segments 180 rotatably mounted on the shaft 178. The bracket 176 includes an L-shaped body 182 having an arcuate inner surface 184 and rectangular end blocks 186 fixedly mounted on the ends thereof. The scoring segments 180 are mounted onto the shaft 176, which in turn, is mounted between the end blocks 186. As such, the scoring segments 180 are mounted for rotation about the shaft 176 and are laterally fixed along the length of the shaft. In these embodiments, the end blocks 186 may include the threaded apertures 70 and oversized apertures 72 for cooperating with the jack screws, as will be described in more detail below.

Figure 3A:
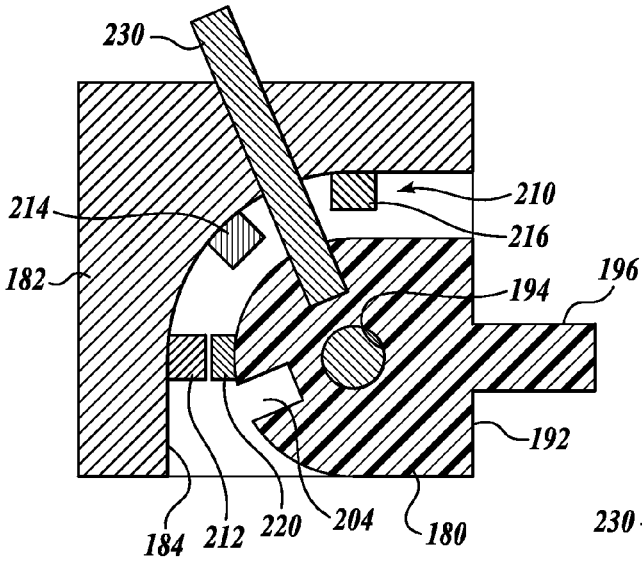
FIGS. 3A-3C are cross-sectional views of the scoring rule of FIG. 2 wherein the scoring segment is actuated from a non-scoring position to a scoring position.
Figure 3B:
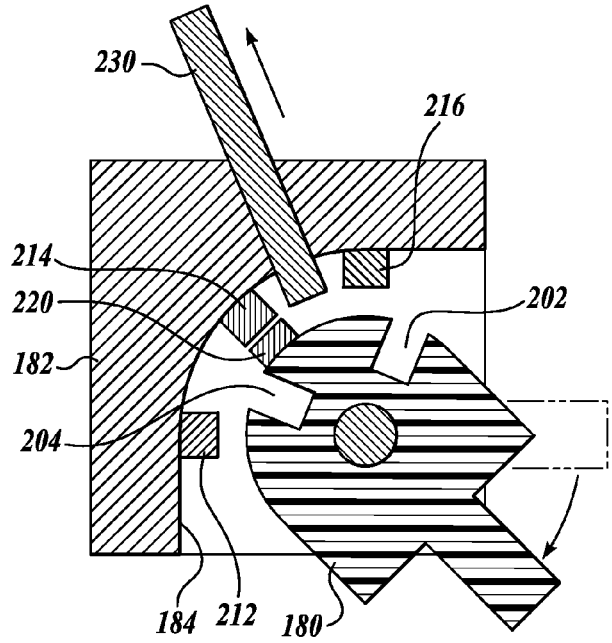
Figure 3C:
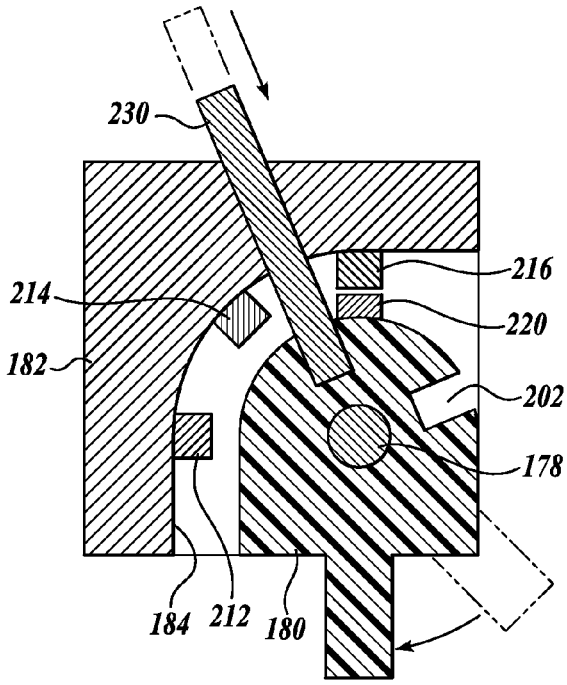
Figure 4:
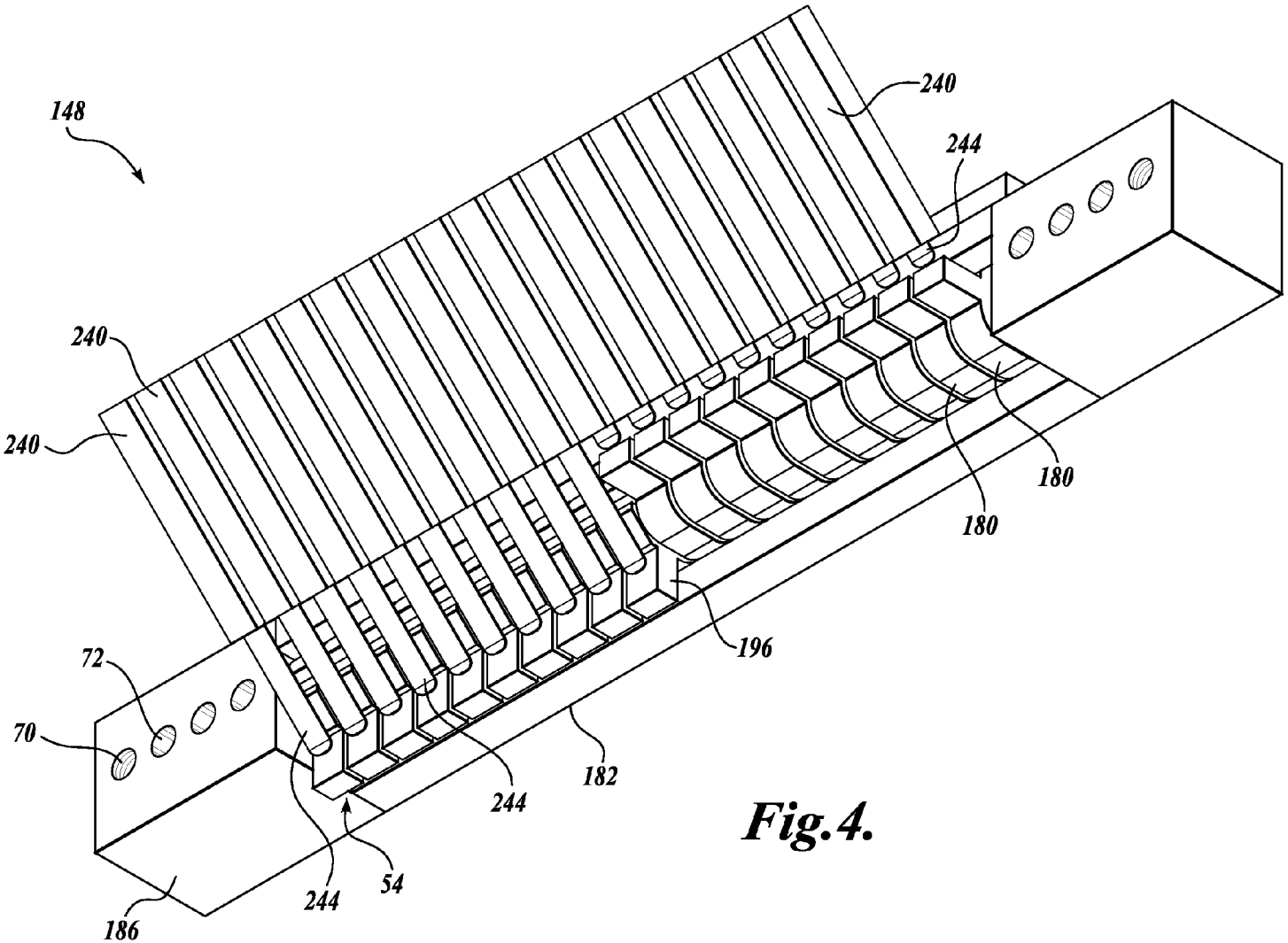
FIG. 4 is a bottom perspective view of another exemplary embodiment of a scoring rule constructed in accordance with aspects of the present invention.
Figure 5A:
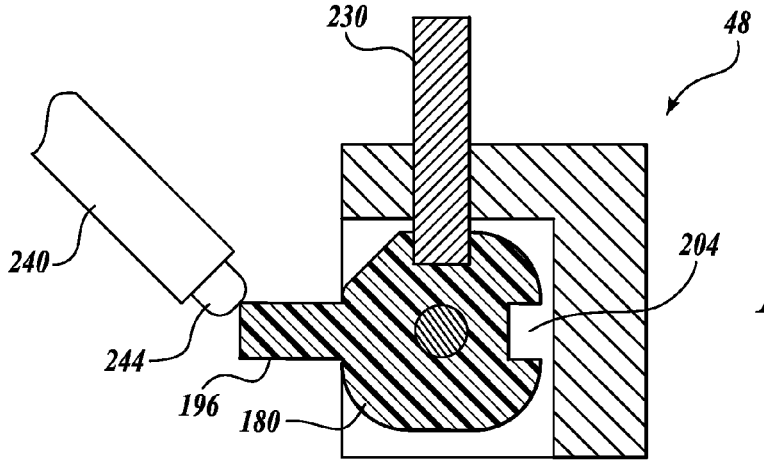
FIGS. 5A-5C are cross-sectional views of the scoring rule of FIG. 4 wherein the scoring segment is actuated from a non-scoring position to a scoring position.
Figure 5B:
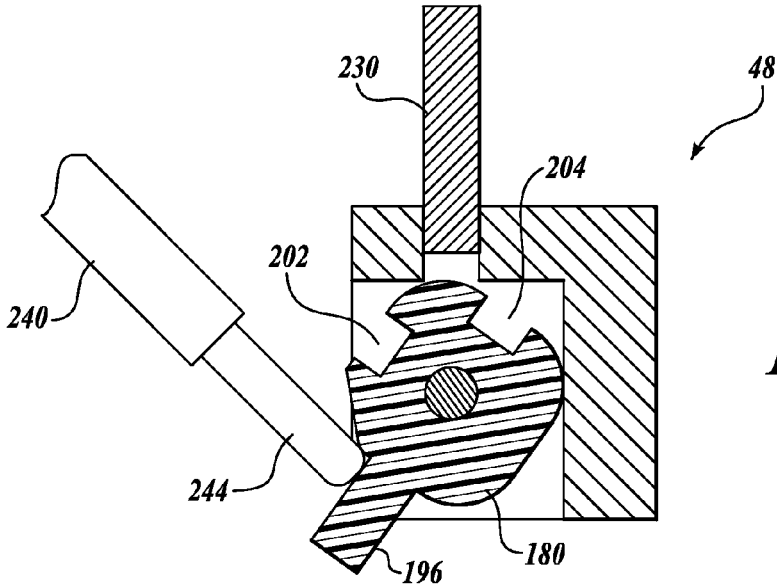
Figure 5C:
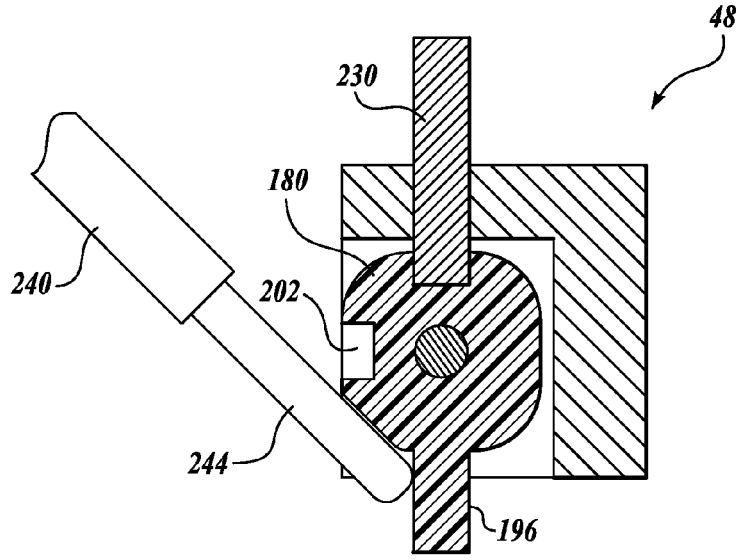

In the embodiment shown in FIGS. 3A-3C, each scoring segment 180 includes a barrel section 192 through which a bore 194 is disposed and a scoring blade section 196 having blunt or truncated end face. In one embodiment, the scoring blade section 196 is rectangular in shape. The scoring segments 180 are mounted onto the shaft 176 through the bores 194. The bores 194 are sized and dimensioned to allow the scoring segments 180 to freely rotate about the shaft 176. The barrel section 192 may further include first and second slots 202 and 204, which are disposed at 90 degrees with respect to each other. As will be described in more detail below, the slots 202 and 204 are used to fix the scoring segments in a selected rotational orientation.

Each scoring segment 180 is capable of rotating between a scoring position, shown in FIG. 3C, and a non-scoring position, as best shown in FIG. 3A. Turning now to FIGS. 3A-3C, there is shown one embodiment of a mechanism that is capable of selectively rotating each scoring segment 180 independently from the others from the non-scoring position to the scoring position. The mechanism in this embodiment utilizes electromagnetic force to rotate the individual scoring segments between the scoring and non-scoring positions. As best shown in FIGS. 3A-3C, the mechanism includes a plurality of sets 210 of three electrodes 212, 214, and 216 with each set of three poles being associated with one discrete scoring segment 180. As best shown in FIGS. 3A-3C, the three poles 212, 214, and 216 are mounted along the arcuate inner surface 184 of the bracket body at evenly spaced intervals. The mechanism further includes a plurality of magnets 220, one of which is associated with each scoring segment 180. The magnets 220 are fixedly mounted to the barrel section 192 of the scoring segments 180 in-between the slots 202 and 204.

Each set 210 of three poles 212, 214, 216 are electrically connected to the computing system 98 through appropriate device circuitry. The device circuitry receives appropriate drive signals generated from the scoring segment orientation module 118, and in response to such control signals, transmits electrical current to the appropriate poles in the appropriate sequence so that the scoring segments 180 rotate from the non-scoring position shown in FIG. 3A to the scoring position shown in FIG. 3C. It will be appreciated that each set of three poles is isolated so it can only actuate its corresponding scoring segment (e.g., no "cross-talk" can occur.)

In operation, electrical current is applied to each pole individually to create a magnetic force attracting the magnet 220 of the respective scoring segment 180 to the pole receiving the electrical current. The magnetic attraction between the respective pole and magnet causes the corresponding scoring segment 180 to rotate so the magnet aligns with the pole that is magnetized. Three alignments of the scoring segment 180 are possible as shown in FIGS. 3A-3C: 1) the non-scoring position with pole 212 energized as shown in FIG. 3A; 2) the intermediate position with pole 214 energized as shown in FIG. 3B; and 3) the scoring position with pole 216 energized as shown in FIG. 3C.

Once each scoring segment have been individually positioned (either in the scoring or non scoring positions) by receipt of appropriate control signals, a scoring segment locking bar 230 may be moved to engage the corresponding slots for holding the custom configuration during die-cutting. Such movement may be controlled by the computing system 98 through appropriate actuators known in the art. It will be appreciated that in several embodiments, the scoring segments 180 may be normally biased in the non-scoring position. As such, when the following conditions occur: 1) one or more scoring segments 180 are in the scoring position; 2) there is no current being delivered to the pole 216; and 3) the locking bar 230 is disengaged, the scoring segments automatically return to the non-scoring position. In one embodiment of the present invention, torsion springs may be suitable disposed between the shaft and the barrel section of the scoring segments for biasing the scoring segments in the non-scoring position. Alternatively, the poles 214 and 216 may be selectively energized in the appropriate sequence to return the scoring segment to the non-scoring position. It will be appreciated that other means for returning the scoring segments to the non-contact position may also be practiced with the aspects of the present invention.

FIGS. 4 and 5A-5C depict another embodiment of a mechanism that can rotate each scoring segment 180 independently from the others from the non-scoring position to the scoring position in response to appropriate control signals. In the embodiment shown, the mechanism includes a number of actuators 240 that corresponds to the number of scoring segments 180. Each actuator 240 includes an extendible member 244 that is capable of extending upon reception of a control signal. The actuators 240 may be either hydraulic, pneumatic, or solenoid controlled linear actuators. In the case of hydraulic or pneumatic actuators, it will be appreciated that associated manifolds, conduits and valves will be included and suitably arranged so as to individually actuate the extendible members 244 of separate actuators 240 between the extended and retracted position. With regard to the solenoid actuator, it will be appreciated that the extendible member 244 may be normally biased to the retracted position. As best shown in FIGS. 4 and 5A-5C, the actuators 240 are positioned at an angle to the scoring segments 180 and are aligned such that each actuator 240 controls one scoring segment 180. Upon actuation of the actuators 240 from the retracted to the extended position, the scoring segments 180 rotate from the non scoring position shown in FIG. 5A to the scoring position shown in FIG. 5C.

Figure 6:
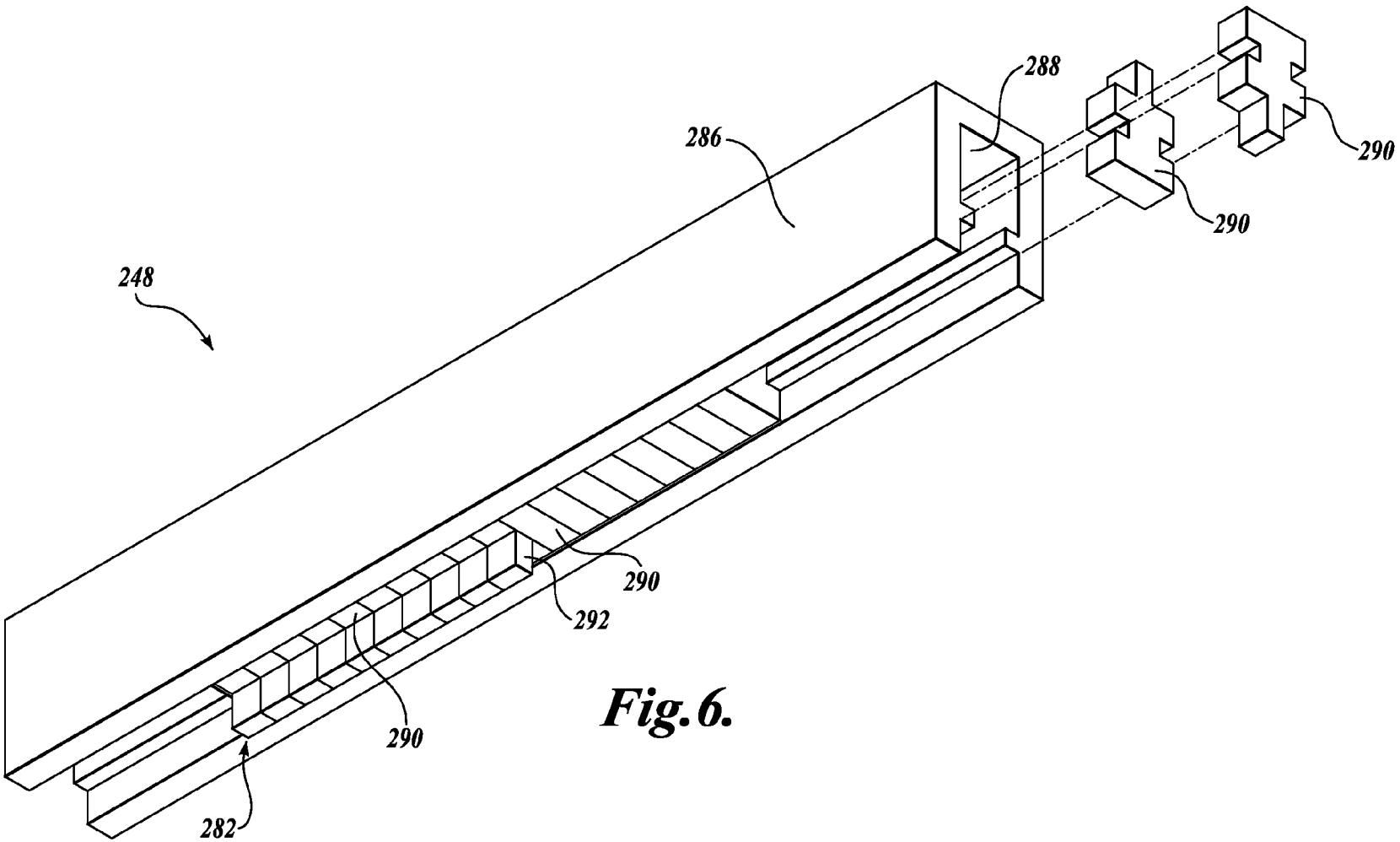
FIG. 6 is a bottom perspective view of another exemplary embodiment of a scoring rule constructed in accordance with aspects of the present invention.
Figure 7A:
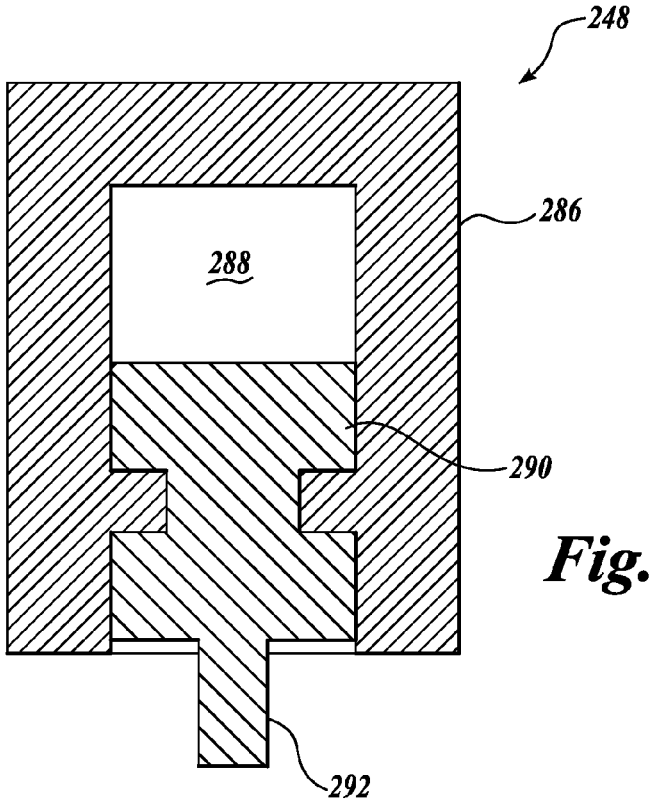
FIG. 7A is cross-sectional views of the scoring rule of FIG. 6 wherein the scoring segment is in the scoring position.
Figure 7B:
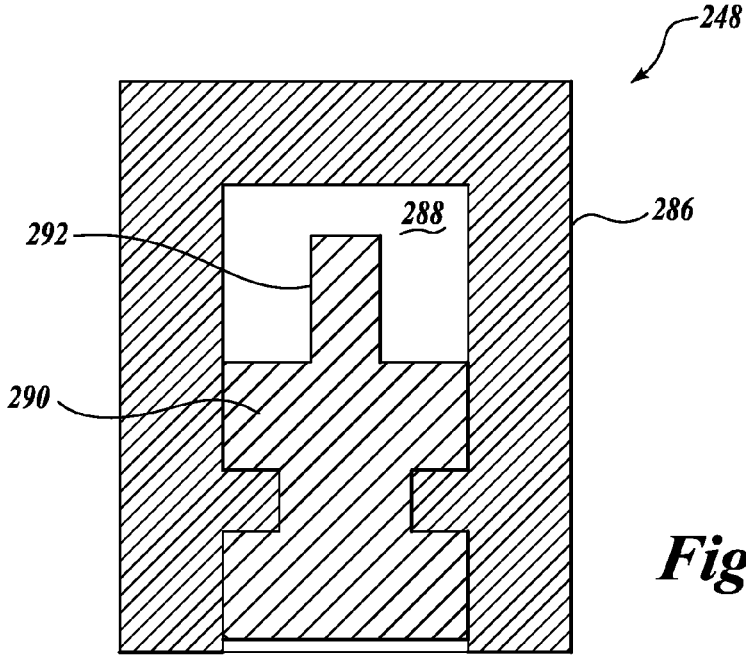
FIG. 7B is a cross-sectional of the scoring rule of FIG. 6 wherein the scoring segment is in the substrate non-scoring position.

FIGS. 6 and 7A-7B illustrate another embodiment of a scoring rule 248 having a scoring blade 282 with selectively adjustable lengths and locations that may be practiced with aspects of the present invention. As best shown in FIGS. 6 and 7A-7B, the scoring rule 248 comprises an elongate body 286 or sleeve that defines a generally H-shaped channel 288 and a plurality of scoring segments 290 configured for insertion into the channel 288. The scoring segments 290 further include a scoring blade section 292 in the form of a blunt or dulled extension. Depending on the insertion orientation of the scoring segments 290, the scoring blade section 292 may be extended in a scoring position as shown in FIG. 7A or a non-scoring position shown in FIG. 7B. To selectively adjust the length and location of the scoring edge, the scoring segments 290 can be individually loaded into the body in either the scoring or non-scoring orientation, depending on the scoring file stored in the computing system 98. It will be appreciated that in one embodiment, the scoring segments can be loaded from a magazine prior to each production run.

Returning to FIG. 1, the second scoring machine 28 will now be described in detail. The scoring machine 28 is substantially identical in construction, materials, and operation to the scoring station 24, except for the differences that will now be described. It will be appreciated that the first scoring machine is configured such the scoring rules are disposed perpendicular to the arrow 52. Accordingly, to form orthogonal scoring lines with the second station, the second scoring machine is configured such that the scoring rules are disposed parallel with the arrow 74. Alternatively, the first scoring station may include scoring rules that are parallel with the arrow 52 and the second scoring station may include scoring rules that are perpendicular to the arrow 74.

Referring again to FIG. 1, there is shown one embodiment of the cutting station 32. The cutting station 32 includes a substrate support platen 40 and a cutting device 80 mounted a spaced distance above the platen 40. The cutting device 40 is preferably movable in both the X and Y planes so that all types of cuts, straight cuts, diagonal cuts, curved cuts, cut outs. etc. may be effected. Additionally, or alternatively, movable (e.g., galvanometer) mirror may be used to direct the laser light with the substrate area. The cutting device 80 can be either a laser cutter, a hydro jet cutter, or a liquid nitrogen cutter, all well known in the art. In other embodiments, the cutting device 80 may be one or more knives operated in a conventional manner to form cut-outs, cut the perimeter shape of the blank, etc. In the latter embodiment, the cutting device would also be movable in the Z plane as well.

The container blank processing system 20 may be controlled by a computing system 98. The computing system 98 includes a computing device 100, including a processing unit 102 and system memory 104 suitable interconnected. The system memory 104 may include read only memory (ROM), random access memory (RAM), and storage memory. The storage memory may include hard disk drives for reading from and writing to a hard disk, a magnetic disk drive for reading from or writing to a removable magnetic disk, and an optical disk drive for reading from or writing to a removable optical disk, such as a CD, DVD or other optical media. The storage memory and their associated computer-readable media provide non-volatile storage of computer readable instruction, data structures, program modules and other data for the computing system 98. Other types of computer readable media which can store data that is accessible by a computer, such as magnetic cassettes, flash memory cards, digital video disks, Bernoulli cartridges, random access memories (RAMs), read only memories (ROMs), and the like, may also be used in the exemplary computing system.

A number of program modules may be stored on the system memory 104, including an operating system 110, one or more application programs 112, including desktop publishing programs, such as Adobe Photoshop®, Adobe Illustrator®, and/or Adobe InDesign®, drafting programs, such as AutoCAD, other program modules 114, such as such as color ink jet print drivers and/or printing preparation programs, a scoring segment orientation module 116, a scoring rule adjustment module 118, and program data 120, such as image files including print files, scoring and cut files, etc.

The scoring rule adjustment module 118 is capable of generating control signals for controlling the positioning of the one or more scoring rules 48A-48D. The appropriate control signals, when received by the jack screw motors 76 via suitable drive circuitry, cause the jack screws to rotate, which in turn, causes the scoring rules 48 to independently travel horizontally with respect to the platen 44 for creating score lines at selective locations along the substrate. The scoring segment orientation module 116 is capable of generating control signals for controlling the orientation of each scoring segment of the scoring rules. The appropriate control signals, when received by the respective actuators 210, 240 via device circuitry, causes one or more scoring segments 180 to move from the non-scoring position to the scoring position for creating customizable score line lengths and locations. It will be appreciated that the modules 116 and 118 may receive position data from one or more position sensors 82 and encoders 84 associated with the movable platen, the scoring rules, and/or the scoring segments so as to properly position the working components of the system.

The computing system 98 is connected in electrical communication with the actuators 50, the motors 76 of the jack screws, the actuators 210, 240, the position sensors 82, the encoders 84, and other conveyance mechanism motors 86 that may be utilized for transferring the substrate from station to station, if utilized, via input/output circuitry 124 or other device level circuitry. The input/output circuitry 124 or other device lever circuitry is capable of receiving, processing, and transmitting appropriate signals between the processing unit and the end devices. The computing system 32 may further include user input devices 140, such as a keyboard, a pointing device, or the like, suitable connected through appropriate interfaces, such as serial ports, parallel ports or a universal serial bus (USB) of the I/O circuitry 124. A monitor 160 or other type of display device may also be included.

Although the detailed description has been described herein with reference to exemplary embodiments illustrated in the attached drawings, it is noted that substitutions may be made and equivalents employed herein without departing from the scope of the present invention as recited in the claims. For example, the scoring rules may be mounted on a theta table so that all orientations of score lines may be effect by a single station, such as parallel, perpendicular, and diagonal score lines.

The embodiments of the invention in which an exclusive property or privilege is claimed are defined as follows:

1. A system for processing a substrate blank, comprising:
a first scoring station including
(a) a stationary platen;
(b) a moveable platen juxtaposed a spaced distance from the stationary platen; and
(c) at least one scoring rule operatively associated with the moveable platen, said scoring rule being moveable between a substrate non-contact position and a substrate contact position by the movable platen for generating a score line on a substrate blank; and
wherein the scoring rule is selectively positionable along one dimension of the moveable platen;
wherein the scoring rule comprises a plurality of scoring segments each defining a scoring blade section, wherein the scoring segments are moveable between a non-scoring position and a scoring position;
wherein the scoring segments are reconfigurable for producing a plurality of different scoring blade lengths.

2. The system of claim 1, further comprising a cutting station that includes a substrate blank cutting device capable of cutting at least a portion of the substrate blank.

3. The system of claim 2, wherein the cutting device is selected from a group consisting of a laser cutter, a knife cutter, a water jet cutter, and a liquid nitrogen cutter.

4. The system of claim 1, wherein the at least scoring rule is two or more scoring rules, each scoring rule being independently moveable in a selectively adjustable manner with respect to the movable platen.

5. The system of claim 1, wherein one or more of the scoring segments are independently actuated to the scoring position.

6. The system of claim 5, wherein the scoring segments are actuated via magnetic forces.

7. The system of claim 5, wherein the scoring segments are actuated via linear actuators.

8. The system of claim 7, wherein the linear actuators are selected from a group consisting of solenoids, pneumatic actuators, hydraulic actuators, and jack screws.

9. The system of claim 1, wherein the scoring segments are biased in the non-scoring position.

10. The system of claim 1, further comprising a second scoring station.

11. The system of claim 1, further comprising a controller operatively connected to each actuator for sending separate control signals that separately activate each scoring segment to the scoring position.

* * * * *